United States Patent [19]

Hellström et al.

[11] Patent Number: 4,574,353

[45] Date of Patent: Mar. 4, 1986

[54] YARN SUPPLY DEVICE GROUP

[75] Inventors: Jerker Hellström, Nol; Lars H. G. Tholander, Huskvarna; Kurt A. G. Jacobsson, Ulricehamn, all of Sweden

[73] Assignee: Aktiebolaget IRO, Ulricehamn, Sweden

[21] Appl. No.: 522,372

[22] PCT Filed: Nov. 4, 1982

[86] PCT No.: PCT/EP82/00238

§ 371 Date: Jun. 29, 1983

§ 102(e) Date: Jun. 29, 1983

[87] PCT Pub. No.: WO83/01634

PCT Pub. Date: May 11, 1983

[30] Foreign Application Priority Data

Nov. 4, 1981 [SE] Sweden ..... 8106506

[51] Int. Cl.[4] ..... G06F 15/46; D04B 15/48

[52] U.S. Cl. ..... 364/470; 66/132 T; 66/163

[58] Field of Search ..... 364/470, 200, 900; 57/81, 263, 264, 265, 58.7, 58.83; 66/232, 237, 125 R, 132 R, 132 T, 158–163

[56] References Cited

U.S. PATENT DOCUMENTS 3,940,951 3/1976 Christiansen ..... 364/900 X
4,005,392 1/1977 Akatsuka et al. ..... 371/29 X
4,031,718 6/1977 Luth ..... 364/143 X
4,294,065 10/1981 Lane ..... 57/81 X
4,386,508 6/1983 Jacobsson ..... 66/132 T
4,408,447 10/1983 Sloupensky ..... 364/470 X

FOREIGN PATENT DOCUMENTS 0026111 4/1981 European Pat. Off. .
81/00870 4/1981 World Int. Prop. O. .

*Primary Examiner*—Joseph Ruggiero
*Attorney, Agent, or Firm*—Flynn, Thiel, Boutell & Tanis

[57] ABSTRACT

The invention relates to a yarn supply device group for attaching to a textile machine, in particular a ring knitting machine with electrically controllable switching and actuating devices in every supply device which are connected in a signal-transmitting circuit by a bunch of lines common to all supply devices to a central control mechanism. Previously, every supply device in the group had to be "marked" manually prior to the start of operation. In addition, a bunch of lines with large dimensions was necessary, since each supply device needed at least one separate line. In the invention, manual "marking" is not needed, since in each supply device an electronic switching arrangement which contains a writable and readable memory is associated with the switching or actuating devices, can be supplied with an individual address from the central control mechanism, and after having been supplied the address can be controlled addresslike, and for connection of the supply device to the central control mechanism a small-dimensioned bunch of lines can be provided since the switching arrangements of all supply devices are connected in the same manner to the bunch of lines.

15 Claims, 7 Drawing Figures

YARN SUPPLY DEVICE GROUP

FIELD OF THE INVENTION

The invention relates to a yarn supply device group for attaching to a textile machine, in particular a ring knitting machine with electrically controllable switching or actuating elements in every supply device which are connected in a signal-transmitting circuit to a central control mechanism by a bunch of lines common to all devices.

BACKGROUND OF THE INVENTION

From European Patent Application No. 801 067 19 (corresponds to U.S. Pat. No. 4,386,508) is known to construct a bunch of lines as a flat multi-conductor cable, in which at least as many conductors or wires are arranged side-by-side as there are supply devices in the supply device group. Since for example fourteen or more supply devices can be associated with one knitting machine, and since for every supply device, if necessary, several lines or wires in the bunch of lines are needed, the bunch of lines has considerable dimensions and is difficult to store, due to extremely cramped space conditions. Furthermore, the function-correct connection and "marking" of the supply devices, prior to the first use of the textile machine or after rearrangement or the connecting or "marking" of one or several exchanged supply devices, is extremely expensive. It is namely necessary that an operator manually and suitably position one or several contact pins inside of the supply device, so that the suitable circuit connections between the switching or actuating elements and the central control mechanism are formed. This manual "marking" in addition is time-consuming and causes an undesirably long stand-still time for the textile machine.

The basis of the invention is the technical problem of how to construct a yarn supply device group of the above-identified type so that the structural provisions for connecting the supply devices to the central control mechanism are considerably reduced and so that mainly the adjusting or "marking" of the supply devices in the supply device group is simplified and can be carried out more quickly.

SUMMARY OF THE INVENTION

The set problem is solved inventively by providing a yarn supply device group in which each supply device has an electronic switching arrangement which contains a writable and readable memory associated with the switching or actuating devices, which can be supplied with a unique address from the central control mechanism and which, after having been supplied with the address, can be controlled by being addressed, wherein the switching arrangements of all supply devices are connected in the same manner to the bunch of lines.

In this construction, due to the electronic switching arrangement, to which can be fed an address from the central control mechanism, a manual marking of each supply device is not necessary. As soon as operation starts, the central control mechanism supplies an address to each electronic switching arrangement, under which address then during operation each supply device can be controlled individually. This means that the supply devices of the group need only be fixed mechanically without "marking" and that then the textile machine is immediately ready for operation. A further, important advantage consists in the bunch of lines containing only a small number of lines, since all supply devices are connected in the same manner to the same lines, so that the connection can be carried out relatively simply and the structural parts and the space for storing the bunch of lines is considerably reduced, because it is no longer necessary to select for each supply device a specific line or lines. The bunch of lines can be integrated structurally without any difficulties into the supply device group or the storing of the group, so that little space is needed for the bunch of lines and it no longer hangs around interferingly between the individual supply devices and the central control mechanism. The standstill times of the textile machine, prior to starting operation, after breakdowns in operation, after change-over operations during which, if necessary, individual supply devices of the group were exchanged, after repair or exchange operations, and during method changes, can be shortened drastically through this.

Particularly advantageous is thereby an embodiment in which the bunch of lines includes a line which is designated for carrying the addresses and is connected to the switching arrangements in series, while the switching arrangements are connected in parallel to the other lines of the bunch of lines. During the first adjusting of the supply devices of the group, just as little care must be taken for connecting the individual cables to the switching arrangement as after exchanging the positions of supply devices of the group, since the exchanged supply devices assume the same positions with respect to the lines of the bunch of lines as the supply devices which were provided earlier at such places. With the series connection in one line of the bundle of lines, the assigning of addresses to the individual supply devices can be carried out according to a relay circuit, so that even after an exchange, supply devices of the group can be controlled again individually from the central control mechanism without having to be "marked" again.

A further advantageous embodiment of the invention provides a microprocessor in each switching arrangement Microprocessors are simple, premanufactured and inexpensive electronic structural elements which can be programmed selectively for respective applications. They are commercially available and require, for example as chips, extremely little space for storage. It would, of course, be conceivable to use in place of a microprocessor a custom electronic switching arrangement; but this would be substantially more expensive than a microprocessor, which is usable for many different purposes and is programmed in view of the expected, known steps.

Since in such a textile machine under certain operating conditions, for example during starting up of the normal operating program or during stopping of a specific quality of goods, the supply devices of the group are supposed to operate only according to a simplified program, or since it may be necessary to leave one or some of all existing supply devices passive, it is advantageous if each switching arrangement has a manually operable switch with which its microprocessor can be separated from the lines of the bunch of lines. Since during switching off of this switching arrangement the current flow in the one line of the bunch of lines in which the switching arrangements are arranged in series remains, the assigning of the addresses to the remaining supply devices and their individual control through the switching off of the switching arrangement is not influenced.

A further, advantageous embodiment involves the microprocessor of each switching arrangement having a read only memory for at least one fixed control program. Fixed programs can be stored in such read only memory or the read only memories and can be read either under control of the central control mechanism or by operations in the respective supply device itself. In this construction, a universal usability of the supply devices is achieved.

Furthermore, also advantageous is an embodiment in which the central control unit contains a microprocessor having an input connected to at least one signal producing control element which provides, for example, the operating clocks, operating position, operating speed and the like of the textile machine. In this manner, not only a structural simplification and universal usability of the central control mechanism for various operating methods is made possible, but it is also assured that the central control mechanism and the supply devices in the group can be operated in strict and desired dependence from the operating clocks or the operating speed during each operating phase. Due to this control of the central control mechanism, it and also the supply devices remain independent from fluctuations in the operating clock or the operating speed during each operating phase. It is thereby also advantageous that the coupling between the textile machine and the central control mechanism occurs also in an electrical or electronic manner which is not susceptible to breakdowns and needs little installation space.

A further, advantageous thought involves the microprocessor of the central control unit being able to store and selectively recall at least one fixed program for effecting a uniform control of all switching arrangements. Here again a central control mechanism right from the start receives the possibility to adjust and uniformly control the supply devices during specific steps which differ from the normal working operation according to these respective conditions.

A further, advantageous measure which results in a simplification of the operation involves the provision in each switching arrangement of a device for detecting, coding and transmitting the occurrence of an error to the central control unit, the central control unit having an error indicator. This additional device in every supply device fulfills the purpose to localize errors which occur in every supply device and to analyze same and make them recognizable by the central control mechanism, so that it can stop the textile machine and at the same time announce the type of error.

It has thereby proven advantageous if each supply device has an error indicator controlled by its microprocessor, since then in the region of the central control mechanism the type of error can be recognized, and in addition it can indicate in which supply device the error occurred. The search for the error and the correction of the error is substantially simplified through this.

An embodiment which is particularly protected against damage from dirt and other outside influences is one in which each yarn supply device has a housing which contains its switching arrangement. Especially during use of a microprocessor, the space which is available in common supply devices is very sufficient for storing the switching arrangement.

Finally, a further advantageous embodiment is one in which the central control unit and the yarn supply device are all supported on an annular carrier. The bunch of lines can hereby be located in the annular carrier, on which is also secured the central control mechanism. Thus, interfering and space-consuming cable connections between the central control mechanism and the supply devices are not needed. As is known already, during fastening of the supply devices on the annular carrier, the respective correct connections between the control mechanism and the switching arrangements can be created.

A particularly advantageous use of the subject matter of the invention results in connection with an electronically or electrically controlled ring knitting machine, in which the individual ring devices are controlled centrally by a so-called pattern computer. Such pattern computer can be connected to the central control unit for the supply devices with the interpositioning of an interface switching circuit, which causes the central control unit and also the microprocessors in the supply devices to be controllable in parallel with the signals from the pattern computer which are also intended for the ring devices and, for example, indicate the respective colors or a color change. Thus, the step which is necessary during the mechanical control of the ring devices is not needed in the individual supply devices, with which step the yarn-guiding arms which are on the output side are lifted into a central position, from which then a signal is formed by a yarn-guiding arm which is moved under the yarn tension from the side of the ring device, which signal indicates to the microprocessor in the supply device which color must now be continuously delivered. This step occurs sensibly during each machine phase, even if no yarn change takes place. During the electronic control of the ring devices, through the saving of this step, a simplification is achieved, since the microprocessors in the supply devices are utilized for fewer switching operations and also the central control unit has to carry out fewer switching operations, since the microprocessors in the supply devices can each be controlled directly with the order for a color change and for the respective color.

BRIEF DESCRIPTION OF THE DRAWINGS

The invention will be described in connection with one exemplary embodiment which is illustrated in the drawings, in which.

DETAILED DESCRIPTION

Figure 6:
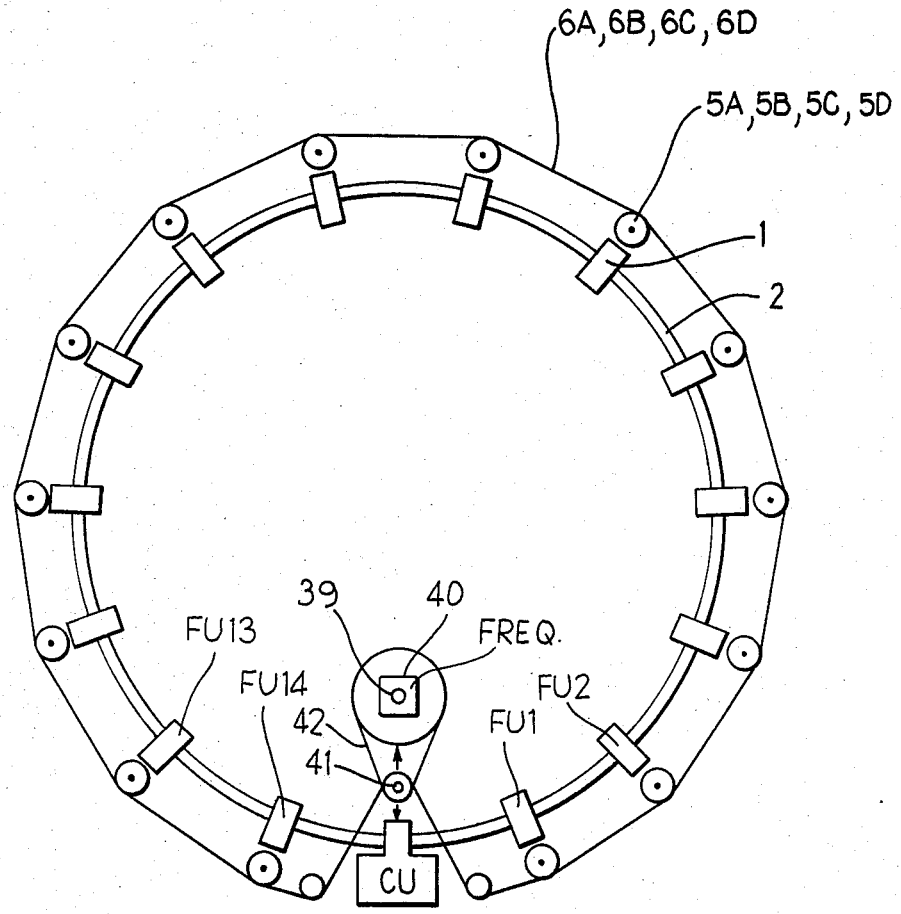
FIG. 6 is a schematic top view of a fourteen-device ring knitting machine.

A supply device for positive yarn delivery has a housing 1 with a clamp portion 3 which can be fastened to a support ring 2 of the knitting machine, namely with a screw 4. The support ring 2 carries above the knitting systems a number of such supply devices which corresponds to the system count of the machine (FIG. 6).

The clamp portion 3 extends with a projection 3A into the housing 1 and divides same into chambers 1A or 1B. The projection 3A extends in FIG. 1 beyond the housing 1 and forms a support plate 3B for a vertical, nonrotatable axle 3C. Several (here four) yarn-feeding wheels 5A, 5B, 5C, 5D are supported rotatably on the axle 3C with bearings (not illustrated). A tape 6A, 6B, 6C or 6D which is driven in synchronism with the knitting machine runs over each wheel. The number of yarn-feeding wheels corresponds with the number of preferably different-colored yarns for the associated ring device.

In the housing 1, at the same level as the wheels 5A, 5B, 5C and 5D, there are supported four times two =eight yarn-guiding arms 7A in, 7A out, 7B in, 7B out, 7C in, 7C out, 7D in, 7D out on axles which extend horizontally into the housing 1.

All arms 7A in, 7B in, 7C in and 7D in for the incoming yarns are supported identically, as are the arms 7A out, 7B out, 7C out and 7D out for the outgoing yarns, so that only the arms 7A in and 7A out will be described hereinafter.

Figure 1:
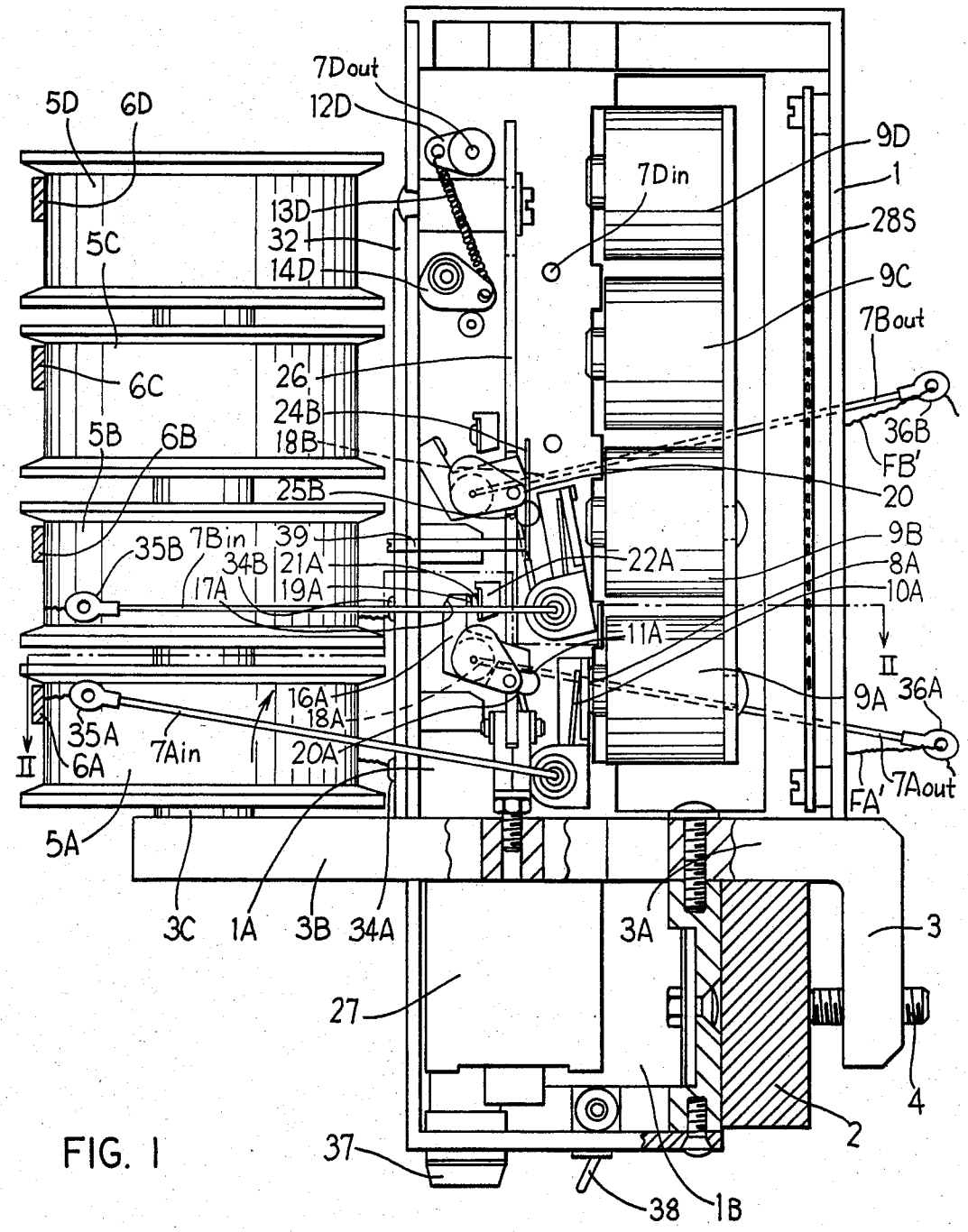
FIG. 1 is a partially cross-sectional side view of an exemplary embodiment of a supply device.

An armature plate 8A is supported on the axle of the arm 7A in, which plate cooperates with an "engagement" electromagnet 9A which, when actuated, swings the armature plate 8A against the action of a spring 10A in a clockwise direction (upward in FIG. 1). When the electromagnet 9A is no longer actuated, the spring moves the arm 7A in a counterclockwise direction (downward in FIG. 1) toward a stop 11A.

A support plate 12A (see 12D in FIG. 1) for a draw spring 13A (see 13D in FIG. 1) is supported on the axle of the arm 7A out, the other end of which draw spring is supported on a support plate 14A (see 14D in FIG. 1) which in turn is secured on the housing 1 by means of a screw 15A. The draw spring 13 pulls the arm 7A out in a counterclockwise direction (namely upward in FIG. 1). On the axle of the arm 7A out, there is fastened an essentially L-shaped plate 16A with a stop surface 17A for limiting counterclockwise movement of the arm 7A out, an actuation surface 18A and a contact plate 19A. A contact cam 20A is secured on the axle of the arm 7A. The contact plate 19A of the L-shaped plate 16A cooperates with a stationary contact plate 21A on a projection 22A. A contact tongue 24A is secured by means of a screw 23A on the projection 22A, which extends vertically downwardly and cooperates with the contact cam 20A. The operating surfaces 18A, 18B, 18C and 18D of the other arms 8B out, 8C out or 8D out cooperate with further operating surfaces 25A, 25B, 25C or 25D of a vertical draw bar 26 which is secured on an armature (not illustrated in FIGS. 1 to 3) of a lifting electromagnet 27. When the electromagnet 27 is actuated, the draw bar 26 is moved upwardly a small distance, which causes the arms 7A out, 7B out, 7C out to be swung in a counterclockwise direction into a center position, since the draw bar 26 with its surfaces 25A, 25B, 25C or 25D engages the plates 16A, 16B, 16C or 16D on the axles of the arms 7A out, 7B out, 7C out or 7D out. The contact cams 20 do not yet cooperate in the center position of the arms with the contact tongues 24.

When the electromagnet 27 is no longer actuated, the draw bar 26 drops back into its rest position, due to its weight and the weight of the armature (FIG. 1).

The contact plates 21A, 21B, 21C and 21D and the contact tongues 24A, 24B, 24C and 24D are connected by (not illustrated) electrical lines to a contact pin 28S (FIG. 1) of an electrical circuit board 28 (FIG. 2) which contains a switching arrangement in the form of a microprocessor which will be described hereinafter.

Figure 2:
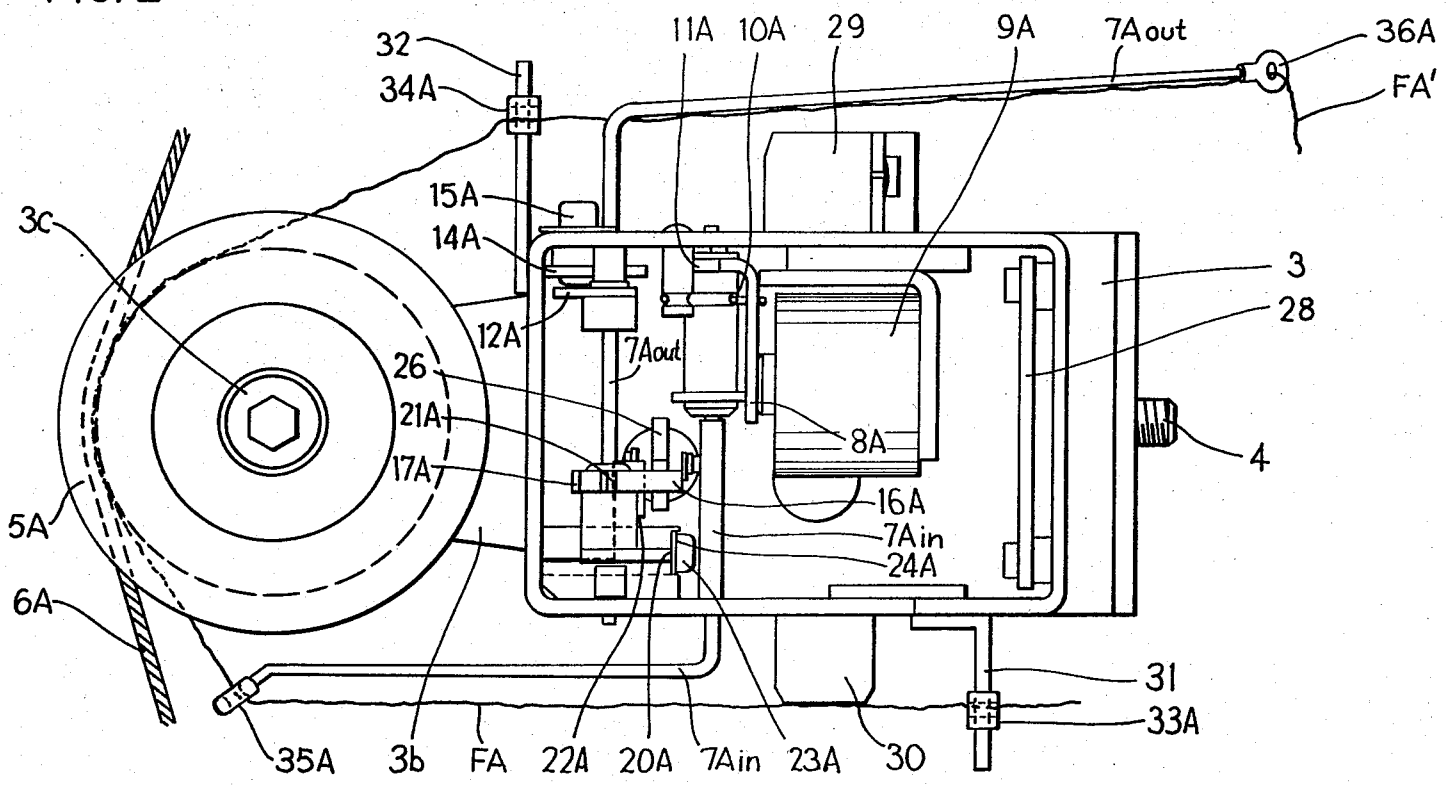
FIG. 2 is a cross-sectional view taken along the line II—II of FIG. 1.
Figure 3:
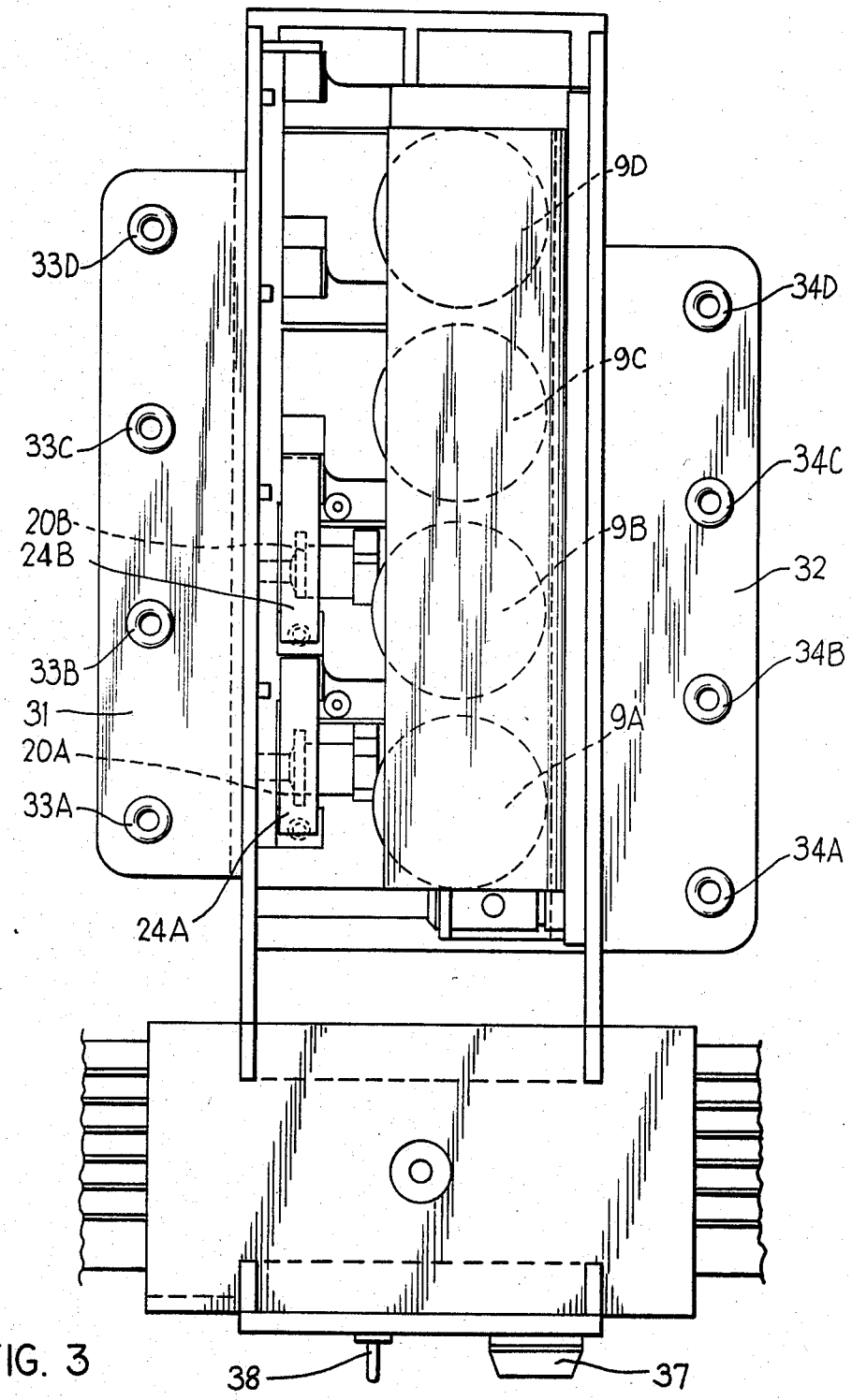
FIG. 3 is a partially cross-sectional rear view of the exemplary embodiment of FIG. 1.

Further contact pins of the electrical circuit board 28 are connected with contact sockets 29 or 30 to further lines (not illustrated), which contact sockets 29 or 30 are provided here on opposite sides of the housing (see FIG. 2). To each socket there is connected a flat cable with preferably six conductors, which is utilized as a so-called "bus cable" in order to feed control signals and a supply current to an electronic central control unit CU (FIGS. 5 and 6) and to receive signals from same, which is preferably secured on the support ring 2 and contains a microprocessor. In place of the sockets 29, 30 it would also be possible to provide a contact-pin arrangement in the chamber 1*b*, with which then the conductors of the bus cable can be connected at the support ring 2.

Furthermore, plates 31 and 32 are secured on the housing 1, which plates extend outwardly and respectively have four fixed ceramic eyelets 33A, 33B, 33C and 33D for guiding the yarns FA, FB, FC or FD and four fixed ceramic eyelets 34A, 34B, 34C and 34D for guiding the yarns FA', FB', FC' or FD'. The yarns are positively guided by the wheels 5A, 5B, 5C or 5D and the tapes 6A, 6B, 6C or 6D and leave the supply device downwardly to a ring device, in which they are detected by fingers and are guided on downwardly to the needles of the knitting machine. Between the eyelets 33A, 33B, 33C or 33D and the wheels 5A, 5B, 5C or 5D, the incoming yarns FA, FB, FC or FD run through ceramic eyelets 35A, 35B, 35C or 35D on the free ends of the arms 7A in, 7B in, 7C in or 7D in.

The outgoing yarns FA', FB', FC' or FD' run through ceramic eyelets 36A, 36B, 36C or 36D at the free ends of the arms 7A out, 7B out, 7C out or 7D out, after they have passed through the eyelets 34A, 34B, 34C or 34D.

A lamp 37 in FIG. 1 provides a visual error indication, while a manual switch 38 is designated for switching off the microprocessor in the supply device.

Figure 4:
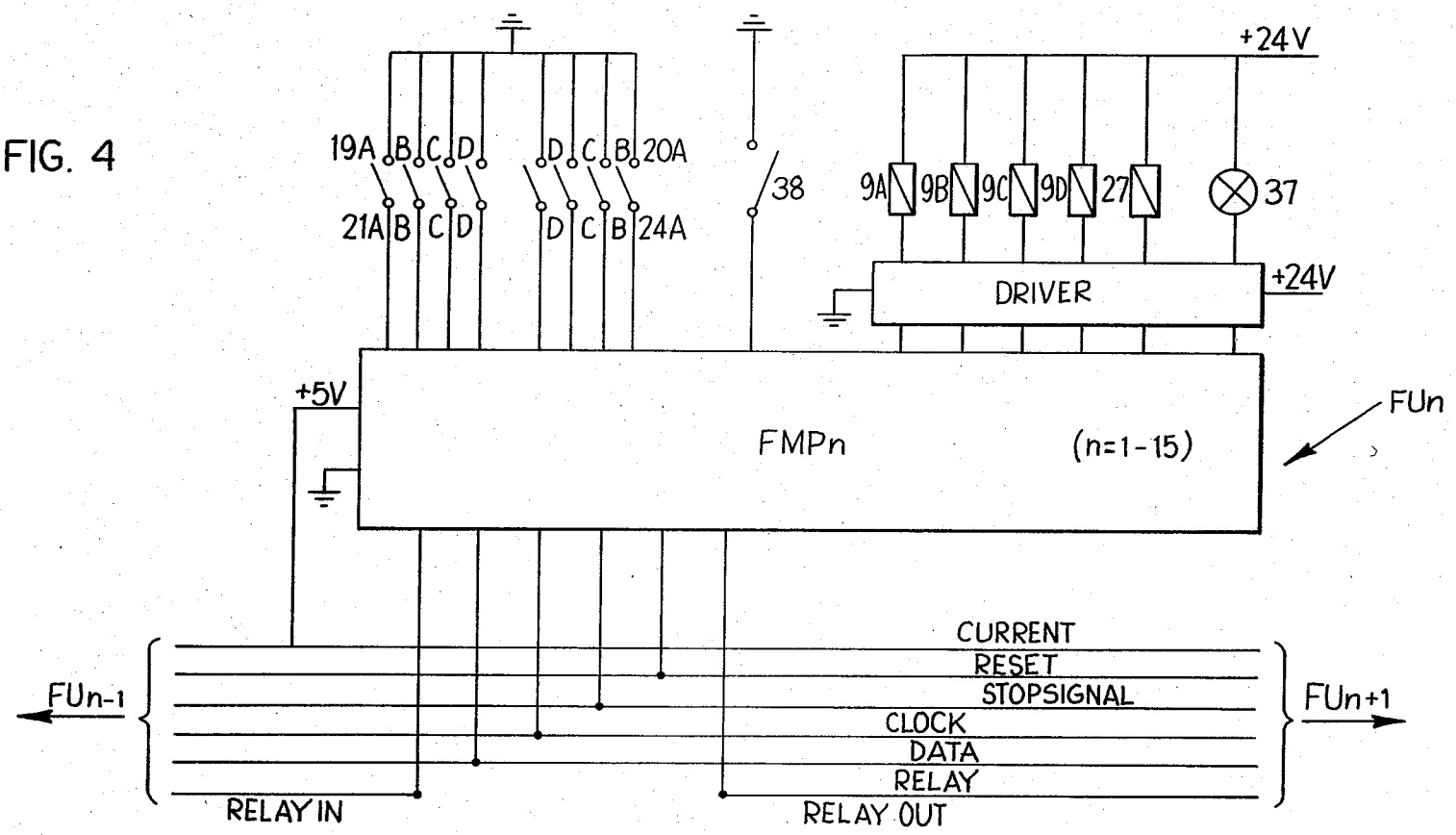
FIG. 4 is a block diagram of the electronic circuit in each supply device.
Figure 5:
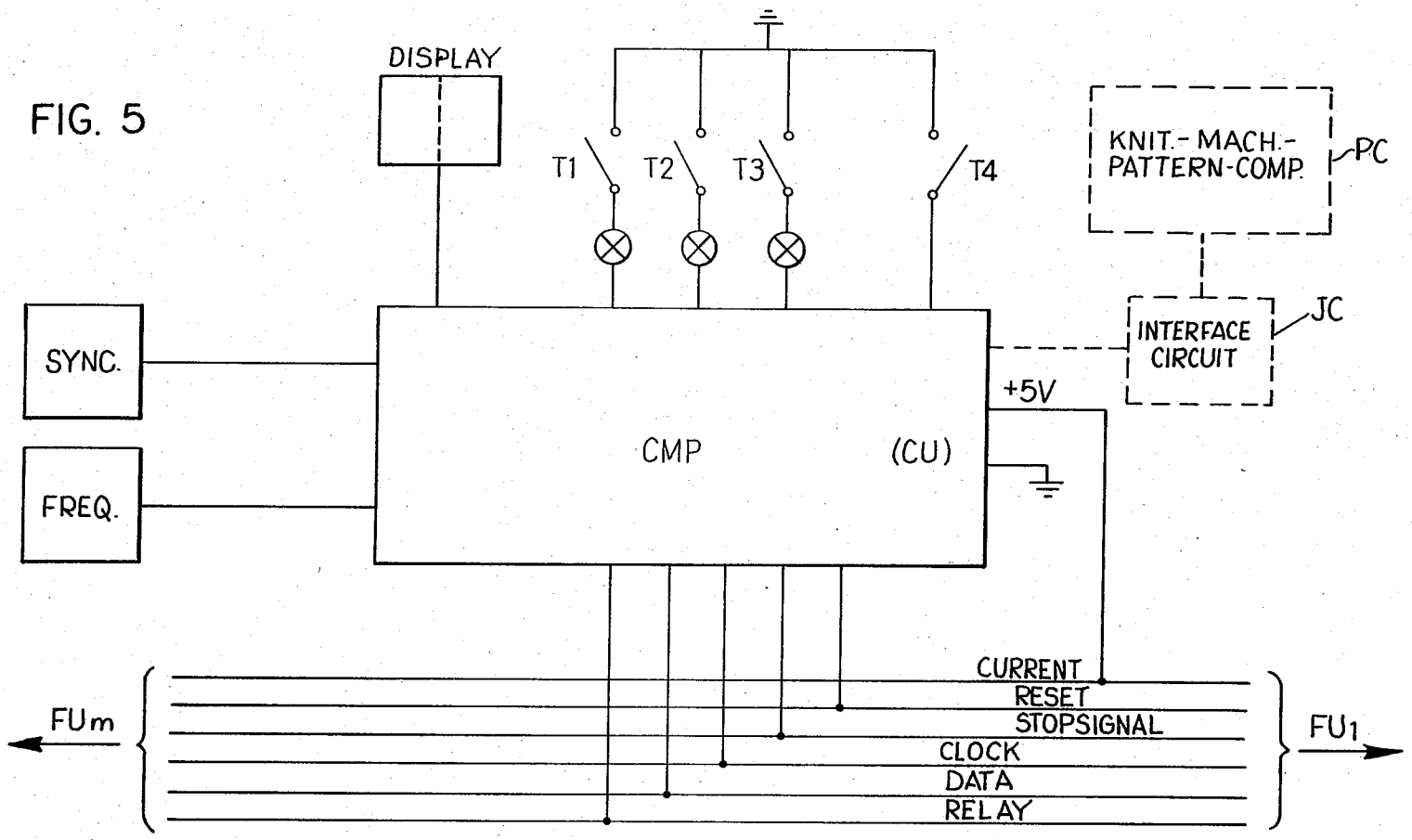
FIG. 5 is a block diagram of an electronic control unit which is utilized for controlling all supply devices of FIG. 1.

FIG. 4 illustrates the microprocessor FMP (supply device microprocessor), for example a so-called "one-chip" microprocessor, in a supply device $FU_n$ (where n lies in this case between one and fourteen). The microprocessor is supplied with a voltage of 5 V (direct voltage) by a voltage threshold, which from a 24 V voltage supply lets through only 5 V for other switching arrangements in the supply device, and is connected by the "bus cable" in the form of the flat cable with six conductors to identical microprocessors of the two adjacent supply devices. The first supply device FU1 (FIG. 6) and the last supply device FU14 of the group are connected to the control unit CU, which is illustrated in FIG. 5 and FIG. 6. The "bus cable" contains a line for the voltage supply and five signal lines for controlling the microprocessor in every supply device or for monitoring the system with respect to occurring errors of various types. These cables are identified in FIG. 4 with: RESET, STOP SIGNAL, CLOCK, DATA, and RELAY. The functions which can be effected therewith will be described later. It is important that the microprocessors FMP are connected in series in the cable RELAY, while in the remaining cables they are connected in parallel with one another.

The microprocessor FMP is connected in the supply device to the "trig" contacts 19A/21A, 19B/21B, 19C/21C and 19D/21D and to the "stop" contacts 20A/24A, 20B/24B, 20C/24C and 20D/24D.

The microprocessor FMP controls, through a driving circuit which is supplied with 24 V, the electromagnets 9A, 9B, 9C and 9D, the lifting magnet 27 and the lamp 37. The manual switch 38 can switch off all functions in the microprocessor FMP, with the exception of the transmission of the RELAY signal. When the switch is in its "off" position, the microprocessor FMP does not take notice of any other information on the "bus cable".

The central control unit CU in FIG. 5 consists in reality of a microprocessor CMP (central microprocessor), which is also a "one-chip" microprocessor supplied with plus 5 V direct voltage.

For synchronizing the operation of the microprocessor CMP in the central unit CU with the operation of the ring knitting machine, a position sensor SYNC is provided (for example a Reed switch) which cooperates with the drive shaft of the rib cylinder of the knitting machine in order to feed one pulse per revolution of the knitting machine to the microprocessor. A for example photoelectrical sensor FREQ cooperates with a toothed disk on the drive shaft of the knitting machine in order to feed a pulse train having a frequency which corresponds to the momentary speed of the knitting machine to the microprocessor CMP in the control unit CU.

The microprocessor CMP is connected to a display DISPLAY in the control unit CU which indicates only two characters which provide a visual, coded indication of the type of an occurring error, whereby for example a yarn breakage is indicated with the code "1 1" and an error in the signal transmission with the code "2 2".

The microprocessor CMP in the control unit CU is connected, for communicating with the respective microprocessors FMP in every supply device of the system, according to the invention to the "six wire bus cable" which is mentioned in connection with FIG. 4.

T1, T2, T3 and T4 (FIG. 5) identify four manual switch buttons in the area of the central control unit, the function of which will be described hereinafter.

FIG. 6 illustrates the supply devices FU1 to FU14 and the control unit CU on the support ring 2 of the knitting machine. It can thereby be recognized how the feeding tapes 6A, 6B, 6C and 6D are driven by a shaft 39 through a roller 40 with a variable diameter (for changing the tape speed) and a stretching device 41 with a drive belt 42.

The described exemplary embodiment operates as follows.

When the power supply for the ring knitting machine is switched on, each supply device FU1 . . . $FU_n$ . . . $FU_m$ in the group receives a specific address from the control unit CU, whereby m equals the total number of supply devices and is fourteen. In other words, each supply device receives a unique number which it keeps until the next addressing operation takes place, namely until the ring knitting machine is switched on the next time.

The addressing is carried out by the control unit CU, which sends out a signal, for example a binary zero (equals a low potential) on the RELAY line when it starts to send pulse trains on the CLOCK line. The signal on the RELAY line enters the microprocessor FMP1 of the supply device number 1 (FU1), whereby same is programmed so that it starts to count and stores in an internal memory the number of clock pulses which occurred up to this point in time on the CLOCK line, namely in this case "one". The signal on the RELAY line continues from the RELAY output of the microprocessor FMP1 in the supply device FU1 to the RELAY input of the microprocessor FMP2 in the supply device FU2, which upon receipt of the RELAY signal reads that so far two pulses occurred on the CLOCK line, whereby this number is stored in its internal memory. The RELAY signal continues to run from supply device to supply device until it has passed the last supply device $FU_m$ of the group, the microprocessor $FMP_m$ of which reads or counts that m pulses have occurred on the CLOCK line, so that this supply device receives the address "m" (for example "fourteen").

The important advantage in this addressing operation or "marking" of the supply devices lies in the supply devices, if this should be desirable for one reason or another, being able to be moved or exchanged freely within the system. The position of each supply device in the group can be changed freely, or alternatively one supply device can be replaced with a new supply device without a "marking" being carried out manually, as is necessary in the known system according to European Patent Application No. 80106719.9. In the known system, the supply devices must be "marked", in that the position of a specific contact pin must be adjusted to a specific wire in the flat multi-conductor cable.

The automatic addressing operation in the inventive system eliminates also the up-to-now existing disadvantage of the first-time "marking" by hand prior to the first operation of the ring knitting machine.

In the described exemplary embodiment, knitting station No. 12, namely supply device FU12, is for example viewed now. At a certain moment, the needles of the ring knitting machine work with the yarn FD', which is fed positively by the uppermost yarn feeding wheel 5D by means of the yarn feeding tape 6D. Just then a change to the yarn FA' takes place in the associated ring device.

Immediately prior to such moment, the control unit CU, which operates in synchronism with the knitting machine, sends out an addressing or calling signal in the form of a 6-bit word (whereby the highest possible address is sixty-four), in this case the number "twelve", namely on the DATA line. The microprocessors in all supply devices FU1 to FU14 receive the information on the DATA line each time they receive a pulse on the CLOCK line. They are programmed so that they compare the calling signal, which was sent out by the central control unit, with the address which is stored in their internal memory and (1) if the comparison is positive, respond to the calling signal by sending back a receipt signal to the central control unit CU on the STOP signal line, whereas,
(2) if the comparison is negative, they do not respond to the calling signal.

Upon receiving back such a receipt signal, the central control unit CU sends out one or several orders or order signals on the DATA line, whereby each order signal is a 4-bit word (the possible total number of orders is sixteen), but only the microprocessor FMP12, which was called, is enabled to read or to receive the order signal or signals which occur on the DATA line. If the central unit does not receive the receipt signal promptly after sending out the addressing or calling signal, it produces in accordance with its program an error indication or a STOP signal for the knitting machine.

At this very moment, the order or the instruction to the microprocessor in the supply device FU12 is to "disengage the positive feed", (order I). During receipt of the order I, the microprocessor FMP of each supply device carries out three different operations, namely:

(1) to switch off the current to all "engagement" electromagnets 9A, 9B, 9C and 9D in the supply device;
(2) to switch on the current to the "lifting" magnet 27;
(3) to switch off the stop function of all arms 7A out, 7B out, 7C out and 7D out, namely the co-acting contact cams 20A, 20B, 20C and 20D and the contact tongues 24A, 24B, 24C and 24D.

Through the operation (1), the "working" arm 7D in is swung inward in a counterclockwise direction, namely downwardly in FIG. 1, which causes the yarn FD on the feeding wheel 5D to be pulled out from under the feeding tape 6D, and the positive feeding is stopped.

Through the operation (2), the draw bar 26 is moved, which causes the "working" arm 7D out, and also the other arms 7A out, 7B out or 7C out, which possibly in this moment are in their lower position, for example due to the elasticity of the yarns, to be rotated a distance in a counterclockwise direction, namely in FIG. 1 upwardly, into a predetermined central position. The contacts 20, 24, however, are not closed.

The central control unit CU now again sends the address signal "twelve" on the DATA line. The microprocessor in the supply device FU12 operates by sending back a receipt signal to the central control unit on the STOP SIGNAL cable, whereupon the control unit CU sends out a new order II on the DATA line, which again is only carried out by the supply device FU12. The order II reads "change the color". The microprocessor FMP of each supply device is programmed to proceed upon receipt of the order II as follows:

(4) all arms 7A out, 7B out, 7C out, 7D out are released, since the lifting magnet 27 is de-energized; and
(5) the current is switched on to the "engagement" electromagnet 9A, 9B, 9C or 9D whose associated arm 7A out, 7B out, 7C out or 7D out has been moved by a yarn FA', FB', FC' or FD' into a so-called "trig position", whereby such yarn must now be processed and is therefore tensioned. The "trig-position" corresponds with the contact position of the plates 19A/21A, 19B/21B, 19C/21C or 19D/21D, in this case the contact plates 19A/21A, as is illustrated in FIG. 1.

Through this operation, the corresponding arm 7A in, 7B in, 7C in or 7D in, in the present case 7A, moves the yarn FA, FB, FC or FD, in the present case FA, upwardly into a position under the corresponding yarn feeding tape on the feeding wheel so that it is fed positively, namely with a constant speed in synchronism with the ring knitting machine.

Figure 7:
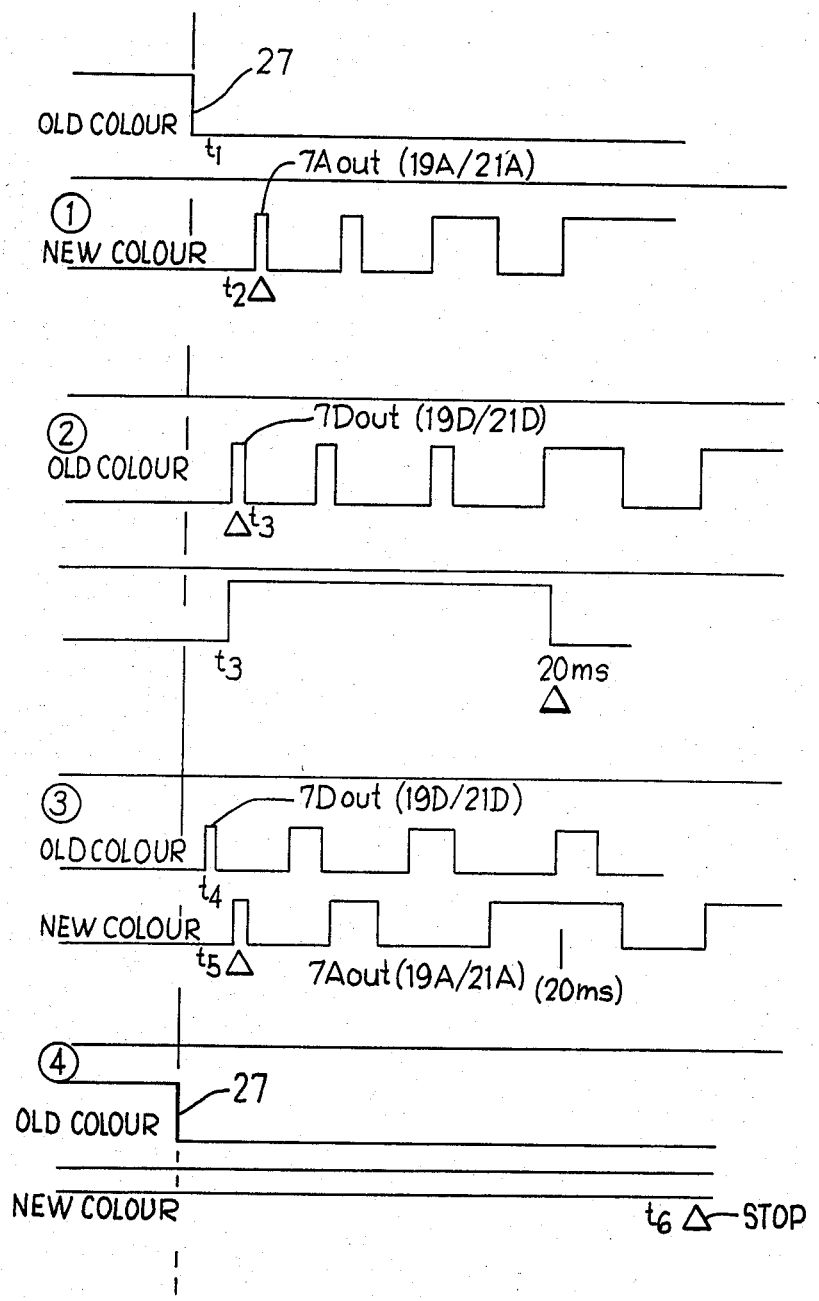
FIG. 7 is a timing diagram for the control of the supply devices.

An internal program routine runs thereby in the microprocessor FMP of the supply device in order to ensure that the correct yarn is fed positively, regardless of the fact that disturbances can occur in the supply device, for example due to an increased tension due to the elasticity of the just stopped yarn. It may also happen that two output arms are moved into the "trig position" and each produce a trig signal. If then the microprocessor FMP would not have any internal program routine (as described hereinafter), two yarns would be fed positively. The internal program routine operates in four different possible cases as follows (see FIG. 7):

The uppermost signal diagram in FIG. 7 illustrates the rear edge of the actuating pulse for the "lifting" magnet 27 of the supply device, namely the electromagnet is de-activated at the moment t1 and releases the arms 7A out, 7B out, 7C out and 7D out, so that they are prepared for the next operation, which produces a "trig signal". In the case 1, namely at the moment t2, the arm 7A was moved outward into the "trig position" due to a color change, since in the ring device a new yarn FA' was picked up. In this case, the microprocessor FMP produces as programmed at the moment t2 an actuating signal and switches on the current to the electromagnet 9A.

In case 2, the arm 7D out was moved with the old yarn FD' at the moment t3 into the "trig position". In this case, a color change in the ring device will not take place during the knitting machine rotation; rather, the needles continue to knit the old yarn FD'. At the moment t3, a "timer routine" starts in the microprocessor FMP, while the microprocessor FMP is waiting for a possible "trig signal" for a new yarn, namely for the yarn FA. If during this "timer routine" (duration 20 ms) such a "trig signal" does not occur, then the microprocessor FMP produces in accordance with the program an actuating signal at the moment t3+20 ms, namely it switches on again the current to the electromagnet 9D for the old yarn, so that same has priority and is again fed positively.

In case 3, the arm 7D out is again moved at the moment t4 with the old yarn FD into the "trig position". The "timer routine" is again started in the microprocessor FMP. However, a short time later, at the moment t5, a "trig signal" is also received by the arm 7A out with the new yarn FA. This can only mean that the arm 7D out was moved at the moment t4 erroneously into the "trig position", probably due to remaining tension in the yarn FD', which cannot be the case with the new yarn FA'. The microprocessor FMP gives, as programmed, the trig signal for the new yarn priority and produces at the moment t5 an actuating signal for the electromagnet 9A.

In case 4, no trig signal occurs whatsoever, either for the old yarn FD or for the new yarn FA, which means that an error exists, for example a yarn breakage. The microprocessor FMP in such supply device now produces and sends, as programmed, at the moment t6, determined by a third order signal III of the central control unit CU, a "GIVE STOP SIGNAL", a stop signal on the STOP SIGNAL line back to the control unit CU, which subsequently again sends out a stop signal to a stop motion relay in the knitting machine for stopping the machine. At this moment, the current to the error-indicating lamp 37 in the supply device which is in question here is switched on, so that the operator can easily determine at which knitting station the error occurred. The microprocessor CMP in the central control unit CU also sends out a signal to its error-type indicator, in the present case for example the code "1 1".

In all of the cases 1, 2 and 3, the microprocessor FMP in the supply device automatically switches on as programmed the stop function for the respective output yarn guiding arm only for the yarn which has given the "trig signal", namely in case 1 for the new yarn FA, in case 2 for the old yarn FD and in case 3 for the new yarn FA. The stop function, namely the current feed to the contact cams 20A, 20B, 20C or 20D and the contact tongues 24A, 24B, 24C or 24D, is programmed so that, in all supply devices, it is switched on promptly after the "trig signal" occurs in the supply device.

In cases 1, 2 and 3, the microprocessor FMP in the supply device accordingly does not answer the order signal 3 "GIVE STOP SIGNAL", since a "trig signal" was received, which means that no error, as for example a yarn breakage, existed.

On the other hand, the microprocessor FMP in every supply device is programmed for normal operation so that it sends back promptly a stop signal on the "STOP SIGNAL" line to the central control unit if a thread breakage in the just knitted yarn occurs, so that the knitting machine is stopped and an error-indicating lamp 37 and the display light up. Moreover, at the same time the current to all "engagement" electromagnets is switched off, so that the positive feeding of the threads is stopped in order to prevent a temporary overfeeding of yarn. After repairing the error, for example a yarn breakage at one of the supply devices, the operator switches on the restart switch T4 in the central control unit CU (see FIG. 5), which causes the microprocessor CMP in the control unit, as programmed, to switch off the current to the stop motion relay of the knitting machine and simultaneously to give the order to the microprocessor FMP in the supply device in which the error to switch off the error-indicating lamp 37 occurred, assuming that the stop contact which is in question here is again open. In this case, no "reset" of the program routine in the control unit takes place, but the system starts again as programmed by carrying out the operation which would have been next when the error occurred.

The operator can reset with the switch T1 the entire program in the microprocessor CMP of the central control unit CU and the microprocessors FMP in all supply devices, whereupon the entire program is again started automatically when the control unit receives the next synchronization pulse from the position sensor SYNC (see FIG. 5).

The switch T2 causes the central control unit CU to send out a specific common order to the microprocessors in all supply devices in order to keep all electromagnets 9A, 9B, 9C and 9D without current so that no yarn is fed positively. The trig signal of the "trig contacts" 19A/21A, 19B/21B, 19C/21C or 19D/21D is thereby, however, designed so that it concerns, just like prior to the stop function, only the yarn which is currently being knitted. This mode of operation can be of considerable importance during running of a new quality of material in the machine, namely before the speed of the tapes 6A, 6B, 6C and 6D (namely the yarn speed) is adjusted correctly in relationship to the speed of the knitting machine.

Finally, the switch T3 effects in the control unit CU an additional specific order to the microprocessors FMP of all supply devices which causes the current to the one of the electromagnets 9A, 9B, 9C, 9D, which was operated by a "trig signal" to remain switched on, whereas the lifting-engagement electromagnets 27 are not actuated as during the normal mode of operation during one machine rotation. This means that the respective yarn is constantly being fed positively. This special function can be utilized when the ring knitting machine is to be used for knitting smooth fabric.

The invention is not limited to the above-described exemplary embodiment which is illustrated in the drawings, and a number of modifications are possible which are within the scope of the invention.

The described exemplary embodiment is intended for a mechanically controlled ring knitting machine, in which the ring devices are controlled in a mechanical manner from a central control unit.

However, the invention can be utilized particularly advantageously for an electronically controlled ring knitting machine, in which the ring devices are controlled electrically through the central control unit. The information for the color change or the yarn change is accessible electrically in the central pattern program system of the knitting machine itself. This means that, in this case, the necessity for a temporary lifting of the arms 7A out, 7B out, 7C out or 7D out into a "central" position and for the lowering of the arms by the new yarn does not exist. Since the temporary lowering of the output yarn guiding arms is not needed, a "lifting" electromagnet 27 is not needed. It is then also unnecessary to block the stop function for the output yarn guiding arm during the time during which the central control unit sends out an order for ending the positive feed in the respective supply device.

In the electrically controlled ring knitting machine, the microprocessor CMP is programmed to send an order for the positive feed to the respective supply device and to simultaneously inform the microprocessor FMP in the supply device which of the four "engagement" electromagnets 9A, 9B, 9C or 9D is to be operated.

Then, the stop function is switched on only for the yarn which was ordered by the central control unit CU for the positive feed.

When using the supply device group in a mechanically controlled ring knitting machine, the microprocessor CMP of the central control unit CU is, in dependence on the respective type of the ring knitting machine, designed or programmed right from the start with various information tables in its internal memory (whereby the information tables can vary in dependence on the number of knitting stations of the machine, the spaces between the knitting stations and the like), so that the operations which as a whole are to be carried out in all supply devices, the sequence in which such operations are to be carried out, and the points in time at which these operations must be carried out is established. The points in time at which these operations must be carried out are determined by establishing at which pulse in the pulse train from the pulse generator FREQ they must be started, whereby the synchronization pulses which the microprocessor receives from the position sensor SYNC are counted.

When using the subject matter of the invention in an electronically controlled ring knitting machine, these information tables for the microprocessor CMP in the central control unit CU do not need to be so extensive, since in this case the microprocessor CMP works "on-line" with the knitting machine pattern computer, namely through an interface circuit IC (indicated by dashes in FIG. 5), and therefore continuously receives information from the pattern computer PC which informs it of the necessary color change data during each machine rotation.

All other functions are in this case substantially the same as in the earlier described exemplary embodiment, which is used in a mechanically controlled ring machine.

We claim:

1. A yarn supply device group, comprising a central control unit, a plurality of yarn supply devices adapted to be attached to a textile machine, and a plurality of conductors which are connected to each said yarn supply device and to said central control unit, wherein each said yarn supply device includes electrically actuable devices and an electronic switching arrangement which controls said electrically actuable devices, each said switching arrangement including a memory which can be written and read and which is adapted to store a unique address sent to the yarn supply device by said central control unit through at least one of said conductors, and wherein said central control unit includes means for sending said unique addresses to said memories of said yarn supply devices when said textile machine is switched on.

2. The yarn supply device group according to claim 1, wherein said plurality of conductors includes a first conductor through which said unique addresses are supplied to said yarn supply devices, said first conductor including a plurality of sections which each extend between a respective pair of said yarn supply devices so that said yarn supply devices are connected in series by said first conductor, said yarn supply devices being connected in parallel to each of the other conductors of said plurality of conductors.

3. The yarn supply device group according to claim 2, wherein each said switching arrangement includes a microprocessor.

4. The yarn supply device group according to claim 3, wherein each said switching arrangement includes manually operable switch means for electrically disconnecting said microprocessor from said other conductors.

5. The yarn supply device group according to claim 3, wherein said microprocessor of each said yarn supply device includes said memory thereof and also includes a read only memory having therein a fixed control program.

6. The yarn supply device group according to claim 1, wherein said central control unit includes a microprocessor having an input to which is connected a control element which generates a clock signal.

7. The yarn supply device group according to claim 6, wherein said microprocessor of said central control unit has further inputs, and including means for supplying signals to said further inputs which represent the operating position and speed of the textile machine.

8. The yarn supply device group according to claim 6, wherein said microprocessor of said central control unit includes a memory which stores at least one fixed control program.

9. The yarn supply device group according to claim 1, wherein each said switching arrangement has means for detecting an error and for transmitting a signal representing said error to said central control unit through said plurality of conductors, and wherein said central control unit includes error indicator means for providing an indication of the occurrence of the error.

10. The yarn supply device group according to claim 9, wherein each said yarn supply device includes a microprocessor and an error-indicating device which can be controlled by said microprocessor.

11. The yarn supply device group according to claim 1, wherein each said switching arrangement is located within a housing of the associated yarn supply device.

12. A yarn supply device group, comprising an annular carrier, a plurality of yarn supply devices which are releasably fastened on said annular carrier and which each include a switching arrangement having first connector means in the region of such fastening and having a memory, a plurality of conductors which are electrically connected to a plurality of second connector means which are in turn releasably coupled to respective said first connector means so as to electrically couple each said yarn supply device to said plurality of conductors, and a central control device supported on said annular carrier and electrically coupled to said plurality of conductors, wherein said central control device includes means for sending a respective unique address through said plurality of conductors to each of said switching arrangements in response to the application of power to the yarn supply device group, each said switching arrangement having means for storing in said memory thereof its unique address, wherein said plurality of conductors includes six wires which lie side-by-side and are each connected to each said second connector means, a first said wire being used to transmit said addresses to said switching arrangements and being a plurality of separate sections which are each electrically coupled at one end to an input of a respective said switching arrangment and at the opposite end to an output of a different said switching arrangement.

13. A yarn supply device group for a textile machine, comprising a control unit, a plurality of yarn supply devices which each include an electronic circuit having a memory which can be written and read, and bus cable means connected to said control unit and to each of said yarn supply devices and having a plurality of conductors; wherein said contol unit includes means for supplying to each said supply device through said bus cable means a unique address in response to the application of power to the textile machine; wherein each said electronic circuit includes means for storing in said memory thereof the unique address supplied thereto; wherein said control unit includes means for sending command signals through said bus cable means during normal operation of the textile machine, each said command signal including a portion which is an address signal and a portion which is an order signal; and wherein each said electronic circuit includes means for comparing said address signal of each said command signal to the unique address stored in its memory and for carrying out a predetermined action in response to the order signal of each said command signal in which the address signal corresponds to the unique address stored in said memory.

14. The yarn supply device group according to claim 13, wherein said bus cable means includes a plurality of identical first connector means provided at spaced locations, and wherein each said yarn supply device includes second connector means releasably coupled to a respective one of said first connector means, said second connector means being identical to each other.

15. The yarn supply device group according to claim 13, wherein said bus cable means includes a current wire for supplying power to said electronic circuit in each said yarn supply device, a reset wire for selectively resetting said electronic circuit in each said yarn supply device, a stopsignal wire through which each said electronic circuit can send signals to said control unit, and a clock wire and data wire which respectively carry a clock signal and data signals from said control unit to each said electronic circuit, and wherein said bus cable means includes a plurality of relay wire segments, one of said relay wire segments connecting an output of said control unit to an input of the control circuit in a respective one of said yarn supply devices, and the rest of said relay wire segments each connecting an output of the control circuit of a respective said yarn supply device to an input of the control circuit of a different said yarn supply device.

* * * * *